US011218807B2

(12) United States Patent
Zotkin et al.

(10) Patent No.: US 11,218,807 B2
(45) Date of Patent: Jan. 4, 2022

(54) AUDIO SIGNAL PROCESSOR AND GENERATOR

(71) Applicant: VisiSonics Corporation, College Park, MD (US)

(72) Inventors: Dmitry N. Zotkin, College Park, MD (US); Nail A. Gumerov, Elkridge, MD (US); Ramani Duraiswami, Highland, MD (US)

(73) Assignee: VisiSonics Corporation, College Park, MD (US)

( * ) Notice: Subject to any disclaimer, the term of this patent is extended or adjusted under 35 U.S.C. 154(b) by 469 days.

(21) Appl. No.: 16/332,680

(22) PCT Filed: Sep. 13, 2017

(86) PCT No.: PCT/US2017/051424
§ 371 (c)(1),
(2) Date: Mar. 12, 2019

(87) PCT Pub. No.: WO2018/053050
PCT Pub. Date: Mar. 22, 2018

(65) Prior Publication Data

US 2021/0297780 A1 Sep. 23, 2021

Related U.S. Application Data

(60) Provisional application No. 62/393,987, filed on Sep. 13, 2016.

(51) Int. Cl.
*H04R 5/027* (2006.01)
*H04R 1/32* (2006.01)
*H04R 1/22* (2006.01)

(52) U.S. Cl.
CPC ..... *H04R 5/027* (2013.01); *H04R 1/222* (2013.01); *H04R 1/326* (2013.01)

(58) Field of Classification Search
CPC ..... H04R 5/027; H04R 1/222; H04R 1/326
See application file for complete search history.

(56) References Cited

U.S. PATENT DOCUMENTS

2010/0329466 A1 12/2010 Berge
2012/0259442 A1 10/2012 Jin et al.
(Continued)

FOREIGN PATENT DOCUMENTS

EP 2 884 491 A1 6/2015

OTHER PUBLICATIONS

International Search Report dated Nov. 20, 2017 in corresponding PCT International Application No. PCT/US2017/051424, 3 pages.
(Continued)

*Primary Examiner* — Jason R Kurr
(74) *Attorney, Agent, or Firm* — Foley & Lardner LLP

(57) ABSTRACT

A spatial-audio recording system includes a spatial-audio recording device including a plurality of microphones, and a computing device. The computing device is configured to determine a plane-wave transfer function for the spatial-audio recording device based on a physical shape of the spatial-audio recording device and to expand the plane-wave transfer function to generate a spherical-harmonics transfer function corresponding to the plane-wave transfer function. The computing device is further configured to retrieve a plurality of signals captured by the microphones, determine spherical-harmonics coefficients for an audio signal based on the plurality of captured signals and the spherical-harmonics transfer function, and generate the audio signal based on the determined spherical-harmonics coefficients.

26 Claims, 4 Drawing Sheets

(56) References Cited

U.S. PATENT DOCUMENTS

| | | | | |
|---|---|---|---|---|
| 2014/0286493 | A1* | 9/2014 | Kordon | H04R 3/005 381/26 |
| 2014/0307894 | A1 | 10/2014 | Kordon et al. | |
| 2014/0358557 | A1 | 12/2014 | Sen et al. | |
| 2015/0078556 | A1 | 3/2015 | Shenoy et al. | |
| 2015/0117672 | A1* | 4/2015 | Christoph | H04R 1/406 381/92 |
| 2015/0319530 | A1 | 11/2015 | Virolainen et al. | |
| 2017/0295429 | A1* | 10/2017 | Poletti | H04R 1/406 |

OTHER PUBLICATIONS

Poletti, M.A., Three-Dimensional Surround Sound Systems Based on Spherical Harmonics, AES, vol. 53, No. 11, Nov. 15, 2005, pp. 1004-1025.

Written Opinion of The International Searching Authority dated Nov. 20, 2017 in corresponding PCT International Application No. PCT/US2017/051424, 9 pages.

International Preliminary Report on Patentability dated Mar. 28, 2019, received in corresponding International Application No. PCT/US2017/051424, 10 pages.

* cited by examiner

AUDIO SIGNAL PROCESSOR AND GENERATOR

CROSS-REFERENCE TO RELATED APPLICATIONS

The present application is a U.S. National Stage of International Application No. PCT/US2017/051424 filed on Sep. 13, 2017, which claims the benefit of U.S. Provisional Patent Application No. 62/393,987, filed on Sep. 13, 2016, the entire disclosures of all of which are incorporated herein by reference.

BACKGROUND

The present application relates to devices and methods of capturing an audio signal, such as a method that obtains audio signals from a body on which microphones are supported, and then processes those microphone signals to remove the effects of audio-wave scattering off the body and recover a representation of the spatial audio field which would have existed in the absence of the body.

Any acoustic sensor disturbs the spatial acoustic field to certain extent, and a recorded field is different from a field that would have existed if a sensor were absent. Recovery of the original (incident) field is a fundamental task in spatial audio. For some sensor geometries, the disturbance of the field by the sensor can be characterized analytically and its influence can be undone; however, for arbitrary-shaped sensor numerical methods are generally employed. In embodiments of the present disclosure, the sensor influence on the field is characterized using numerical (e.g. boundary-element) methods, and a framework to recover the incident field, either in the plane-wave or in the spherical wave function basis, is provided. Field recovery in terms of the spherical basis allows the generation of a higher-order ambisonics representation of the spatial audio scene. Experimental results using a complex-shaped scatterer are presented.

SUMMARY OF THE INVENTION

The present disclosure describes systems and methods for generating an audio signal.

One or more embodiments described herein may recover ambisonics, acoustic fields of a specified order via the use of boundary-element methods for computation of head-related transfer functions, and subsequent playback via spatial audio techniques on devices such as headphones.

In one embodiment, a spatial-audio recording system includes a spatial-audio recording device including a number of microphones, and a computing device configured to determine a plane-wave transfer function for the spatial-audio recording device based on a physical shape of the spatial-audio recording device, and expand the plane-wave transfer function to generate a spherical-harmonics transfer function corresponding to the plane-wave transfer function. The computing device is further configured to retrieve a number of signals captured by the microphones, determine spherical-harmonics coefficients for an audio signal based on the plurality of captured signals and the spherical-harmonics transfer function, and generate the audio signal based on the determined spherical-harmonics coefficients.

In one aspect, the computing device is further configured to generate the audio signal based on the determined spherical-harmonics coefficients by performing processes that include converting the spherical-harmonics coefficients to ambisonics coefficients.

In one aspect, which is combinable with the above embodiments and aspects in any combination, the computing device is configured to determine the spherical-harmonics coefficients by performing processes that include setting a measured audio field based on the plurality of signals equal to an aggregation of a signature function including the spherical-harmonics coefficients and the spherical-harmonics transfer function.

In one aspect, which is combinable with the above embodiments and aspects in any combination, the computing device is further configured to determine the signature function including spherical-harmonics coefficients by expanding a signature function that describes a plane wave strength as a function of direction over a unit sphere into the signature function including spherical-harmonics coefficients.

In one aspect, which is combinable with the above embodiments and aspects in any combination, the computing device is configured to determine the plane-wave transfer function for the spatial-audio recording device by performing operations that include implementing a fast multipole-accelerated boundary element method, or based on previous measurements of the spatial-audio recording device.

In one aspect, which is combinable with the above embodiments and aspects in any combination, the number of microphones are distributed over a non-spherical surface of the spatial-audio recording device.

In one aspect, which is combinable with the above embodiments and aspects in any combination, the computing device is configured to determine the spherical-harmonics coefficients based on the plurality of captured signals and the spherical harmonics transfer function by performing operations that include implementing a least-squares technique.

In one aspect, which is combinable with the above embodiments and aspects in any combination, the computing device is configured to determine a frequency-space transform of one or more of the captured signals.

In one aspect, which is combinable with the above embodiments and aspects in any combination, the computing device is configured to generate the audio signal corresponding to an audio field generated by one or more external sources and substantially undisturbed by the spatial-audio recording device.

In one aspect, which is combinable with the above embodiments and aspects in any combination, the spatial-audio recording device is a panoramic camera.

In one aspect, which is combinable with the above embodiments and aspects in any combination, the spatial-audio recording device is a wearable device.

In another embodiment, a method of generating an audio signal includes determining a plane-wave transfer function for a spatial-audio recording device including a number of microphones based on a physical shape of the spatial-audio recording device, and expanding the plane-wave transfer function to generate a spherical-harmonics transfer function corresponding to the plane-wave transfer function. The method further includes retrieving a number of signals captured by the microphones, determining spherical-harmonics coefficients based on the plurality of captured signals and the spherical-harmonics transfer function, and generating an audio signal based on the determined spherical-harmonics coefficients.

In one aspect, which is combinable with the above embodiments and aspects in any combination, the generating the audio signal based on the determined spherical-harmonics coefficients includes converting the spherical-harmonics coefficients to ambisonics coefficients.

In one aspect, which is combinable with the above embodiments and aspects in any combination, the determining the plane-wave transfer function for the spatial-audio recording device includes implementing a fast multipole-accelerated boundary element method, or based on previous measurements of the spatial-audio recording device.

In one aspect, which is combinable with the above embodiments and aspects in any combination, determining the spherical-harmonics coefficients includes setting a measured audio field equal to an aggregation of a signature function including the spherical-harmonics coefficients and the spherical-harmonics transfer function.

In one aspect, which is combinable with the above embodiments and aspects in any combination, determining the signature function including spherical-harmonics coefficients by expanding a signature function that describes a plane wave strength as a function of direction over a unit sphere into the signature function including spherical-harmonics coefficients.

In one aspect, which is combinable with the above embodiments and aspects in any combination, the spherical-harmonics transfer function corresponding to the plane-wave transfer function satisfies the equation:

$$H(k, s, \tau_j) = \sum_{n=0}^{p-1} \sum_{m=-n}^{n} H_n^m(k, \tau_j) Y_n^m(s),$$

where $H(k,s,r_j)$ is the plane-wave transfer function, $H_n^m(k, r_j)$ constitute the spherical-harmonics transfer function, $Y_n^m(s)$ are orthonormal complex spherical harmonics, k is a wavenumber of the captured signals, s is a vector direction from which the captured signals are arriving, n is a degree of a spherical mode, m is an order of a spherical mode, and p is a predetermined truncation number.

In one aspect, which is combinable with the above embodiments and aspects in any combination, the signature function including spherical-harmonics coefficients is expressed in the form:

$$\mu(k, s) = \sum_{n=0}^{p-1} \sum_{m=-n}^{n} C_n^m(k) Y_n^m(s),$$

where $\mu(k,s)$ is the signature function, $C_n^m(k)$ constitute the spherical-harmonics coefficients, $Y_n^m(s)$ are orthonormal complex spherical harmonics, k is a wavenumber of the captured signals, s is a vector direction from which the captured signals are arriving, n is a degree of a spherical mode, m is an order of a spherical mode, and p is a predetermined truncation number.

In one aspect, which is combinable with the above embodiments and aspects in any combination, the spatial-audio recording device is a panoramic camera.

In one aspect, which is combinable with the above embodiments and aspects in any combination, the spatial-audio recording device is a wearable device.

In another embodiment, a spatial-audio recording device includes a number of microphones, and a computing device configured to determine a plane-wave transfer function for the spatial-audio recording device based on a physical shape of the spatial-audio recording device. The computing device is further configured to expand the plane-wave transfer function to generate a spherical-harmonics transfer function corresponding to the plane-wave transfer function, and retrieve a number of signals captured by the microphones. The computing device is further configured to determine spherical-harmonics coefficients based on the plurality of captured signals and the spherical-harmonics transfer function, convert the spherical-harmonics coefficients to ambisonics coefficients, and generate an audio signal based on the ambisonics coefficients.

In one aspect, which is combinable with the above embodiments and aspects in any combination, the computing device is configured to determine the plane-wave transfer function for the spatial-audio recording device based on a mesh representation of the physical shape of the spatial-audio recording device.

In one aspect, which is combinable with the above embodiments and aspects in any combination, the audio signal is an augmented audio signal.

In one aspect, which is combinable with the above embodiments and aspects in any combination, the microphones are distributed over a non-spherical surface of the spatial-audio recording device.

In one aspect, which is combinable with the above embodiments and aspects in any combination, the spatial-audio recording device is a panoramic camera.

In one aspect, which is combinable with the above embodiments and aspects in any combination, the spatial-audio recording device is a wearable device.

DETAILED DESCRIPTION

Figure 1:
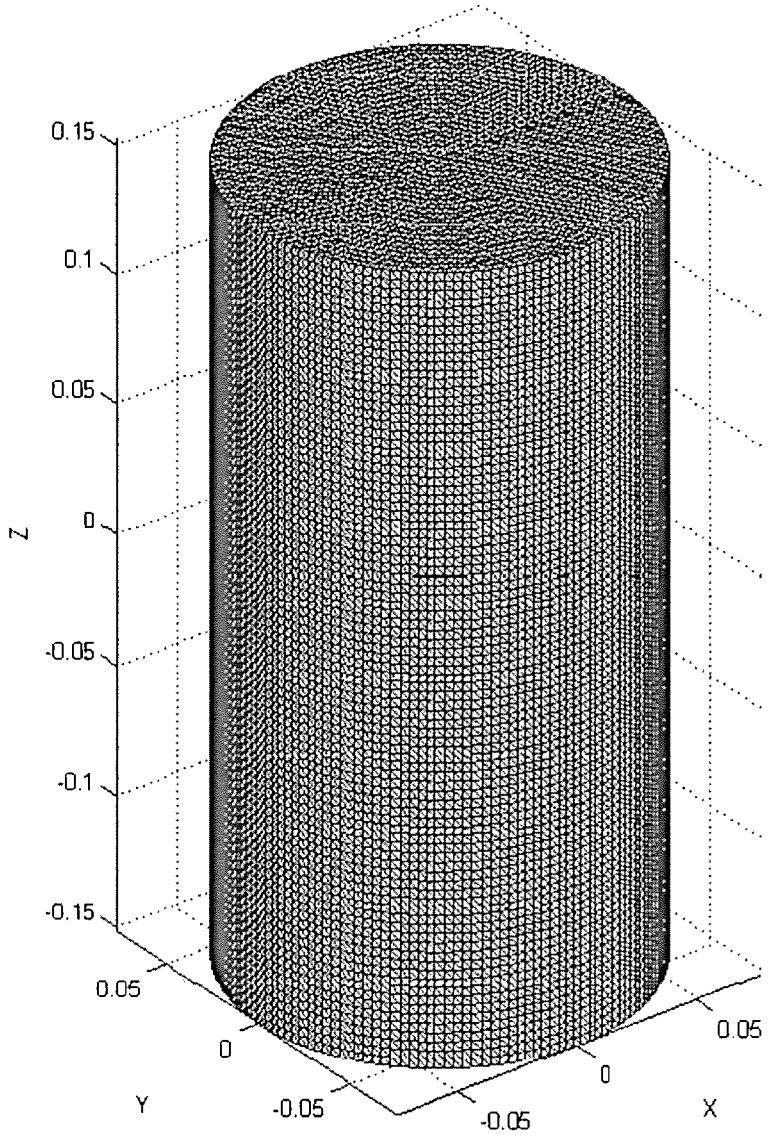
FIG. 1 shows a boundary-element method model.

The present disclosure provides for many different embodiments. While certain embodiments are described below and shown in the drawings, the present disclosure provides only some examples of the principles of described herein and is not intended to limit the broad aspects of the principles of described herein to the embodiments illustrated and described.

Embodiments of the present invention provide for generating an audio signal, such as an audio signal that accounts for, and removes audio effects of, audio-wave scattering off of a body on which microphones are supported.

Spatial audio reproduction is an ability to endow the listener with an immersive sense of presence in an acoustic scene as if they were actually there, either using headphones, or a distributed set of speakers. The scene presented to the listener can be either synthetic (created from scratch using individual audio stems), real (recorded using a spatial audio recording apparatus), or augmented (using real as a base and adding a number of synthetic components). This work is focused on designing a device for recording spatial audio; the purpose of such a recording may be sound field reproduction as described above or sound field analysis/scene understanding. In either case, it is necessary to capture the spatial information available in audio field for reproduction and/or scene analysis.

Any measurement device disturbs, to some degree, the process being measured. A single small microphone offers the least degree of disturbance but may be unable to capture the spatial structure of the acoustic field. Multiple coincident microphones recover the sound field at a point and are used in the so-called ambisonics microphones, but it may be infeasible to have more than a few microphones coincident (e.g. 4). A large number of microphones randomly placed in the space of interest are able to sample the field spatial structure very well; however, in reality microphones are often physically supported by rigid hardware, and designing the set-up in a way so as not to disturb the sound field is difficult, and furthermore the differences in sampling locations requires analysis to obtain the sound-field at a specified point. One solution to this issue is to shape a microphone support in a way (e.g., as a rigid sphere) so that the support's influence on field can be computed analytically and factored out of the problem. This solution is feasible; however, in most cases the geometry of the support is irregular and is constrained by external factors. As an example, one can think of an anthropomorphic (or a quadruped) robot, whose geometry is dictated by a required functionality and/or appearance and for which an audio engineer must use the existing structural framework to place the microphones for spatial audio acquisition.

In the present description, a method to factor out the contribution of an arbitrary support to an audio field and to recover the field at specified points as it would be if the support were absent is proposed. The method is based on numerically computing the transfer function between the incident plane wave and the signal recorded by a microphone mounted on support as a function of plane wave direction and microphone location (due to linearity of Helmholtz equation, an arbitrary audio scene can be described as a linear combination of plane waves, providing a complete representation; or via the spherical wave function basis). Such a transfer function is similar to the head-related transfer function (HRTF). For the sake of simplicity, it will be called "HRTF" in this work (although an arbitrary-shaped support is used and no "head" is involved; note that the HRTF is a somewhat of a misnomer as other parts of the body, notably the pinnae and shoulders, also contribute to sound scattering). Further, having the HRTF available and given the pressure measured at microphones, the set of plane-wave coefficients that best describes the incident field is found using a least-squares solution.

Another complete basis over the sphere is the set of spherical wave functions (SH). Just like the HRTF is a potential generated by a single basis function (plane wave) at the location of the microphone, an HRTF-like function can be introduced that describes the potential created at the microphone location by an incident field constituted by a single spherical wave function. This approach offers computational advantages for deriving HRTF numerically; also, it naturally leads to a framework for computing incident field representation in terms of the SH basis, which is used in the current work to record incoming spatial field in ambisonics format at no additional cost.

The present disclosure is organized as follows. First, relevant literature is reviewed and the novel aspects of the current work are outlined. Second, description of the notation used and a review of SH/ambisonics definitions is provided. Third, a degenerate case of using a spherical array (with analytically-computable HRTF) as ambisonics recording device is presented. Fourth, an arbitrary scatterer, outlines of a procedure for computing its HRTF using numerical methods, and the theoretical formulation for "removal-of-the-scatterer" procedure of computing the incident field as it would be were the scatterer not present is provided. Fifth, the results of simulated and real experiments both with spherical and arbitrary-shaped scatterer are provided. Additional general description follows thereafter.

In order to extract spatial information about the acoustic field, one can use a microphone array; the physical configuration of such an array obviously influences capture and processing capabilities. Said captured spatial information can be used then to reproduce the field to the listener to create spatial envelopment impression. In particular, a specific spatial audio format invented simultaneously by two authors in 1972 for the purposes of extending then-common (and still now-common) stereo audio reproduction to third dimension (height) represents the audio field in terms of basis functions called real spherical harmonics; this format is known as ambisonics. A specific microphone array configuration well-suited for recording data in ambisonics format is a spherical array, as it is naturally suited for decomposing the acoustic scene over the SH basis.

While a literature suggestive of creating an ambisonics output using spherical microphone array exists, the details of processing are mostly skimped on, perhaps because the commercial arrays used in literature are bundled with software converting raw recording to ambisonics. This is also noted in the review, where methods of 3D audio production mentioned are i) use of a Soundfield microphone (a Soundfield microphone, by its principles of mechanical and signal processing design, captures the real SH of order 0 and 1) for real scenes or ii) implementation of 3D panner for synthetic ones. In some works, only the standard SH decomposition equations are provided. Meanwhile, a number of practical details important to actual implementation are not covered, and the present disclosure fills those blanks in regard to the simple spherical array.

With respect to an arbitrary-shaped scatterer, the HRTF computation using a mesh representation of the body has been a subject of work for a while by different authors. The inventors of embodiments described in the present disclosure have explored fast multipole method for computing HRTF using SH basis earlier, and since then have improved the computational speed by several orders of magnitude compared with existing work. While traditional methods of sound field recovery operate in plane-wave (PW) basis and their output can be converted into SH domain using Gegenbauer expansion, in some embodiments of the present disclosure the SH framework is adopted throughout; this is especially convenient as the immediate output of BEM-based HRTF computation is the HRTF in a SH sense. It is straightforward to convert SH HRTF to PW HRTF and vice-versa, but avoidance of unnecessary back-and-forth conversion, which can introduce inaccuracies and/or computational inefficiencies (such as straining computational resources), is important and is provided for by embodiments described herein; in addition, any practical implementation requires writing appropriate software, and some of the methods described herein can be more quickly implemented in software and readily debugged. Hence, present disclosure is a first attempt to provide for converting a field measured at microphones mounted on an arbitrary scatterer to an ambisonics output in one step, assuming scatterer's SH HRTF is pre-computed (using BEM or otherwise) or measured. FIG. 1 shows a BEM model used in some simulations described herein (V=17876, F=35748).

An arbitrary acoustic field $\Psi(k, r)$ in a spatial domain of radius d that does not contain acoustic sources can be decomposed over a spherical wavefunction basis as $$\Psi(k, \tau) = \sum_{n=0}^{\infty} \sum_{m=-n}^{n} C_n^m(k) j_n(kr) Y_n^m(\theta, \psi). \tag{1}$$

where k is the wavenumber, r is the three-dimensional radius-vector with components $(\rho, \theta, \psi)$ (Specifically, $\theta$ here is a polar angle, also known as colatitude (0 at zenith and $\pi$ at nadir), and $\psi$ is azimuthal angle increasing clockwise), $j_n(kr)$ and $h_n(kr)$ are the spherical Bessel/Hankel function of order n, respectively (the latter is defined here for later use), and $Y_n^m$ $(\theta, \psi)$ are the orthonormal complex spherical harmonics defined as $$Y_n^m(\theta, \psi) = (-1)^m \sqrt{\frac{2n + 1(n - |m|)!}{4\pi(n + |m|)!}} P_n^{|m|}(\cos\theta) e^{im\psi} \tag{2}$$

where n and m are the parameters commonly called degree and order, and $P_n^{|m|}$ $(\mu)$ are the associated Legendre functions.

In practice, the outer summation in Eq. (1) is truncated to contain p terms. Setting p as approximately equal to (ekd−1)/2 has been shown to provide negligible truncation error. Ambisonics representations ignore the wavenumber dependence and use a decomposition in terms of spherical harmonics alone, and moreover use a purely real valued representation of spherical harmonics. Shown below is the orthonormal version (called N3D normalization in the literature):

$$\tilde{Y}_n^m(\theta, \psi) = \delta_m \sqrt{2n + 1} \sqrt{\frac{(n - |m|)!}{(n + |m|)!}} P_n^{|m|}(\cos\theta) \Upsilon_m(\psi), \tag{3}$$

where $\Upsilon_m(\psi)=\cos(m\psi)$ when $m\geq 0$, $\sin(m\psi)$ otherwise; and $\delta_m$ is 1 when m=0, sqrt(2.0) otherwise. In SN3D normalization, the factor of sqrt(2n+1) is omitted. Care should be taken when comparing and implementing expressions, as symbols, angles, and normalizations are defined differently in work of different authors. In particular, Eq. (3) uses the same angles as Eq. (2); however, elevation and azimuth as commonly defined for ambisonics purposes are different from definition used here. For example, in ambisonics, elevation is 0 on equator, $\pi/2$ at zenith, and $-\pi/2$ at nadir; and azimuth increases counterclockwise.

Eq. (1) (after truncation) can be re-written in terms of real spherical harmonics as $$\Psi(k, r) = \sum_{n=0}^{p-1} \sum_{m=-n}^{n} \tilde{C}_n^m(k) \tilde{Y}_n^m(\theta, \psi) \tag{4}$$

using a different set of expansion coefficients $\tilde{C}_n^m(k)$, assuming evaluation at a fixed frequency and radius, a constant factor of $j_n(kr)$ into those coefficients (as we are interested only in angular dependence of the incident field). Note that $\tilde{C}_n^m$ (k) set is, in fact, an ambisonics representation of the field, albeit in the frequency domain. Hence, recording a field in ambisonics format amounts to determination of $\tilde{C}_n^m$ (k). The number p−1 is called order of ambisonics recording (even though it refers to the maximum degree of the spherical harmonics used). Older works used p=2 (first-order); since then, higher-order ambisonics (HOA) techniques has been developed for p as high as 8. The following relationship, up to a constant factor, can be trivially derived between $$\tilde{C}_n^0 = C_n^0,\ \tilde{C}_n^{-m} = i\frac{\sqrt{2}}{2}(C_n^m - C_n^{-m}) \qquad \tilde{C}_n^m = \frac{\sqrt{2}}{2}(C_n^m + C_n^{-m}) \tag{5}$$

This disclosure provides for computing $C_n^m$ (k) (obtaining a representation of the field in terms of traditional, complex spherical harmonics), and the conversion to $\tilde{C}_n^m$ (k) can be done as a subsequent or final step as per above.

Figure 2:
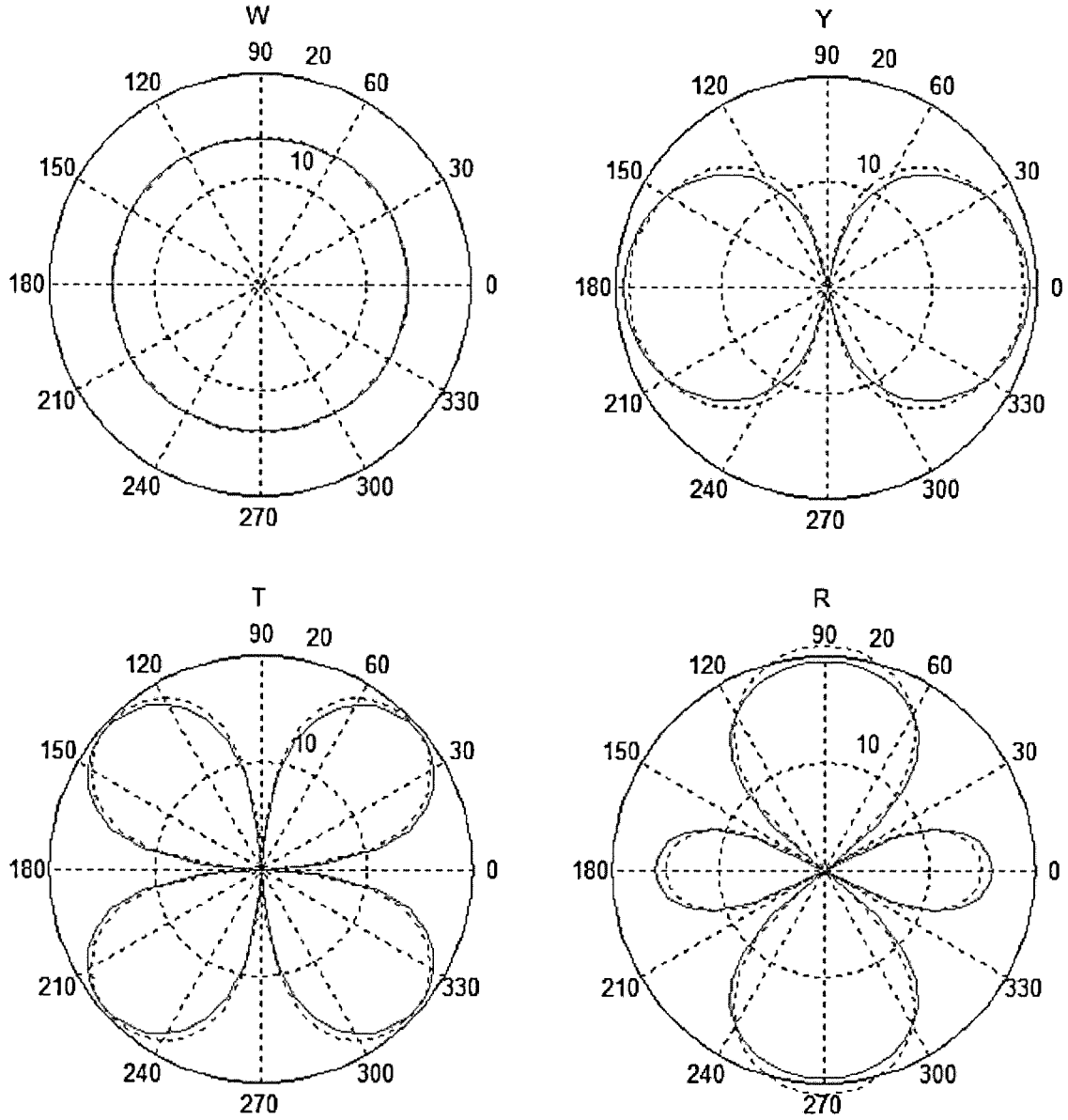
FIG. 2 shows an angular response magnitude for W, Y, T, and R first order ambisonics channels at 1.5 kilohertz (kHz) with measurement signal-to-noise ratio (SNR)=20 dB.

FIG. 2 shows an angular response magnitude for W, Y, T, and R ambisonics channels at 1.5 kHz with measurement SNR=20 dB (solid: array response, dashed: corresponding spherical harmonic). Channel names are given in FuMa nomenclature.

In a direct approach, for a continuous pressure-sensitive surface of radius a, the computation of $C_n^m$ (k) is performed as $$C_n^m(k) = -i(ka)_i^{2\cdot n} h'_n(ka) \int_{S_u} \Psi(k,s) Y_n^{-m}(s) dS(s) \tag{6}$$

where integration is done over the sphere surface and $\Psi(k, s)$ is the Fourier transform of the acoustic pressure at point s, which is proportional to the velocity potential and is loosely referred to as the potential in this paper. Assume that L microphones are mounted on the sphere surface at points $r_j$, j=1 . . . L. The integration can be replaced by summation with quadrature weights $\omega_j$:

$$C_n^m(k) = -i(ka)^2 i^n h'_n(ka) \sum_{j=1}^{L} \omega_j \Psi(k, r_j) Y_n^{-m}(r_j) \tag{7}$$

Figure 3:
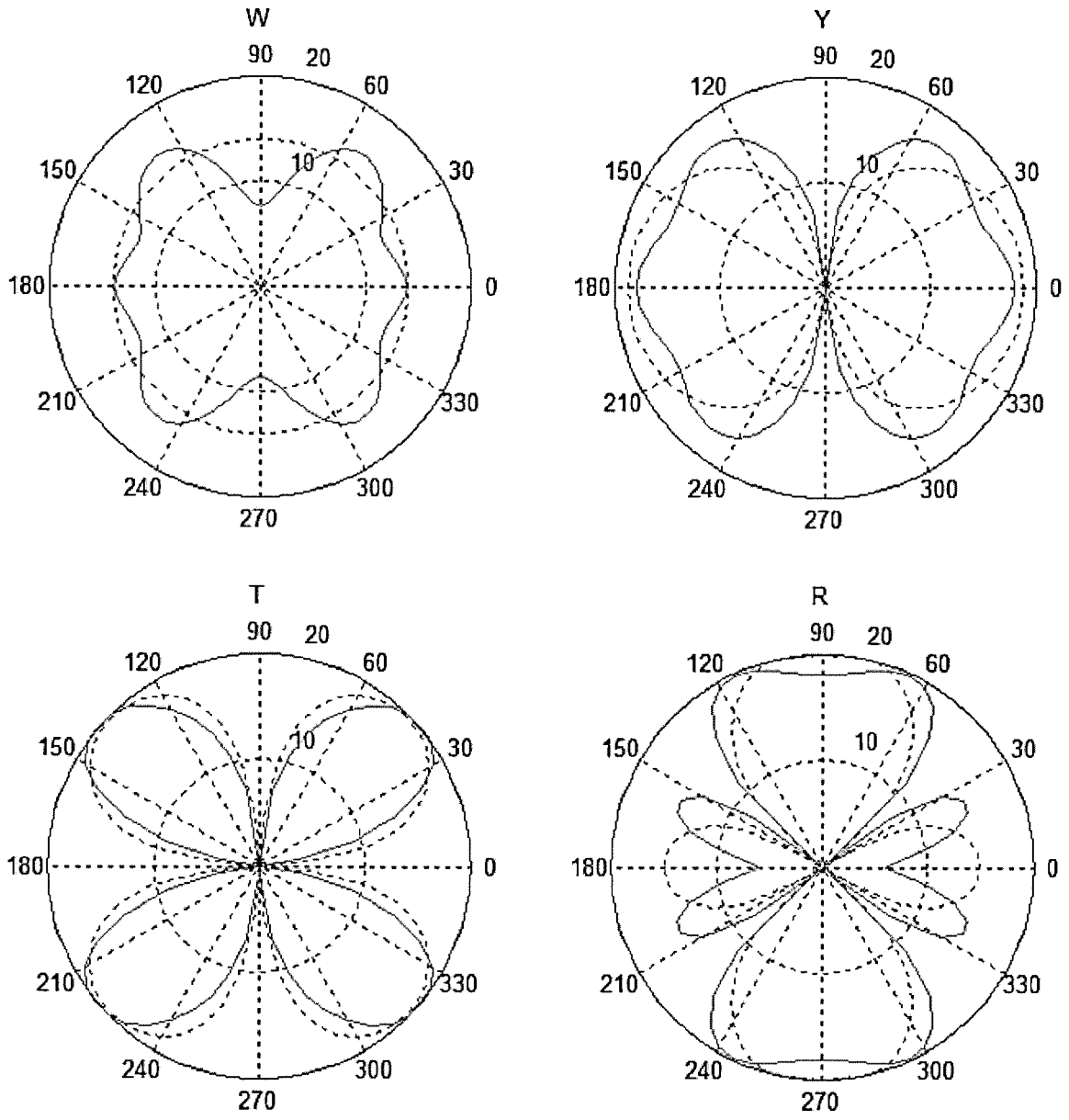
FIG. 3 shows an angular response similar to that shown in FIG. 2, except that ambisonics channel frequency=3 kHz.

FIG. 3 shows an angular response similar to that shown in FIG. 2, except where ambisonics channel frequency=3 kHz.

The direct approach, above, involves high-quality quadrature over the sphere, which can be difficult to acquire. An alternative approach is to figure out the potential $\Psi(k, r_j)$ that would be created by a field described by a set of $C_n^m$ (k):

$$\Psi(k, r_j) = 4\pi i^{-n} \frac{i}{(ka)^2} \sum_{n=0}^{p-1} \sum_{m=-n}^{n} \frac{C_n^m(k) Y_n^m(r_j)}{h'_n(ka)} \tag{8}$$

This equation links the mode strength and the microphone potential. The kernel $$H_n^m(k, r_j) = 4\pi i^{-n} \frac{i}{(ka)^2} \frac{Y_n^m(r_j)}{h'_n(ka)} \tag{9}$$

is nothing but the SH-HRTF for the sphere, describing the potential evoked at a microphone located at $r_j$ by a unit-strength spherical mode of degree n and order m. Given a set of measured $\Psi(k, r_j)$ at L locations and assuming an overdetermined system (e.g. $p^2<L$), one could compute the set of $C_n^m$ (k) that "best-fit" the observations using least-squares by multiplying measured potentials by pseudoinverse of matrix H. Even though quadrature is no longer explicitly involved, sufficiently uniform microphone distribution over the sphere is required for matrix H to be well-conditioned.

This leads to some practical limitations: Given a truncation number p, the minimum number of microphones required to accurately sample the field is $p^2$; hence, a 64-microphone sphere can be used to record ambisonics audio of order 7. Further limits on both lowest and highest operational frequency are imposed by physical array size and inter-microphone distance, respectively.

Using numerical methods, it is possible to compute SH-HRTF for an arbitrary-shaped body; a detailed description of the fast multipole-accelerated boundary element method (BEM) involved is presented in [16, 17]. The result of the computations is the set of SH-HRTF $H_m^m$ (k, r) for arbitrary point r. Assume that, via BEM computations or otherwise (e.g., via experimental measurements), SH-HRTF is known for the microphone locations $r_j$, j=1 . . . L. The plane-wave (regular) HRTF $H(k, s, r_j)$ describing a potential evoked at microphone located at $r_j$ by a plane wave arriving from direction s is expanded via SH-HRTF as $$H(k, s, r_j) = \sum_{n=0}^{p-1} \sum_{m=-n}^{n} H_n^m(k, r_j) Y_n^m(s). \tag{10}$$

At the same time, the measured field $\Psi(k, r_j)$ can be expanded over plane wave basis as $$\Psi(k,r_j)=\int_{S_u}\mu(k,s)H(k,s,r_j)dS(s) \tag{11}$$

where $\mu(k, s)$ is known as the signature function as it describes the plane wave strength as a (e.g. continuous) function of direction over the unit sphere. By further expanding it over spherical harmonics as $$\mu(k, s) = \sum_{n=0}^{p-1} \sum_{m=-n}^{n} C_n^m(k) Y_n^m(s). \tag{12}$$

the problem of determining a set of $C_n^m$ (k) from the measurements $\Psi(k, r_j)$ is reduced to solving a system of linear equations $$\sum_{n=0}^{p-1} \sum_{m=-n}^{n} C_n^m(k) H_n^{-m}(k, r_j) = \Psi(k, r_j),\ j = 1 \ldots L, \tag{13}$$

for $p^2$ values $C_n^m$ (k), which follows from Eq. (11) and orthonormality of spherical harmonics. When $p^2<L$, the system is overdetermined and is solved in the least-squares sense, as for sphere case. Other norms may be used in the minimization. Note that the solution above can also be derived from the sphere case (Eq. (8)) by literally replacing the sphere SH-HRTF (Eq. (9)) with BEM-computed arbitrary scatterer SH-HRTF in the equations. Thus, the spherical-harmonics can be determined based on the equality shown in Eq. (11).

Figure 4:
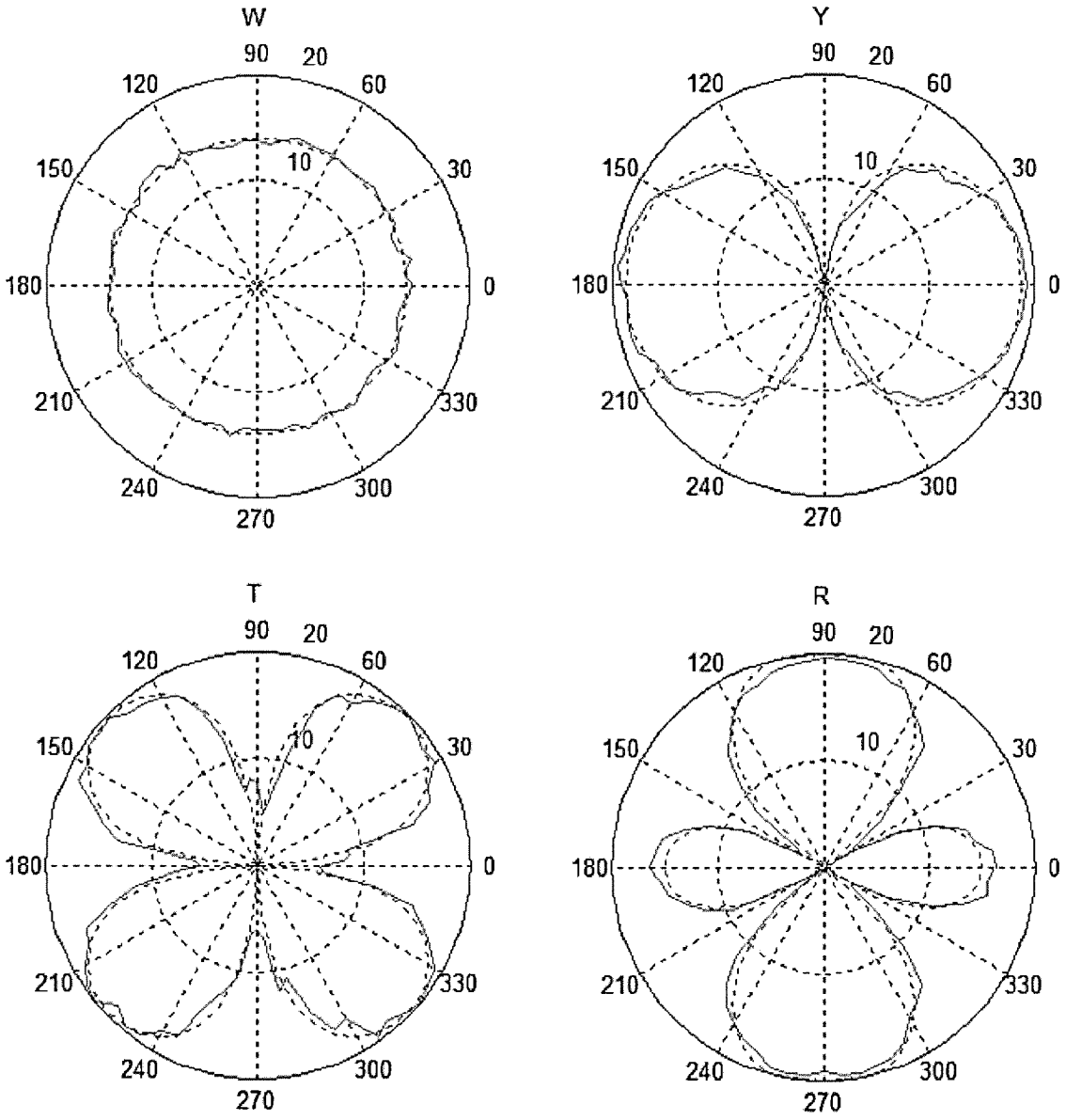
FIG. 4 shows an angular response similar to that shown in FIG. 2, except that SNR=0 dB.

FIG. 4 shows an angular response similar to that shown in FIG. 2, except SNR=0 dB.

An informal experimental evaluation of the spherical array case was performed using a 64-microphone array with microphones places as per Fliege 64-point grid first introduced into microphone analysis by [25]. The input time-domain signals are converted into frequency domain to obtain microphone potentials for a discrete set of k. The algorithm described is then applied to obtain $C_n^m$ (k), and the inverse Fourier transform is applied to $C_n^m$ (k) for each n/m combination to form the corresponding time-domain output ambisonics signals.

The resultant TOA (third-order ambisonics) recordings were evaluated aurally using Google Jump Inspector. Higher-order outputs (up to order seven, p=8) were also created and evaluated using an internally-developed head-tracked player. Good externalization and consistent direction perception were reported by users.

In addition, simulated experiments were performed with arbitrarily-shaped scatterer, chosen to be in a shape of a cylinder for this experiment. Note that despite its seemingly simple shape, there is no analytical way to recover the field for this shape. The sound-hard cylinder has a height of 12 inches and a diameter of 6 inches. The cylinder surface was discretized with at least 6 mesh elements per wavelength for the highest frequency of interest (12 kHz). BEM computations were performed to compute the SH-HRTF for 16 frequencies from 0.375 to 6 kHz with a step of 375 Hz. Simulated microphones were placed on the cylinder body in 5 equispaced rings along the cylinder length with 6 equispaced microphones on each ring. In addition, the top and bottom surfaces also had 6 microphones mounted on each in a circle with a diameter of 10/3 inches, for a grand total of 42 microphones. The mesh used is shown in FIG. 1. Per spatial Nyquist criteria, the aliasing frequency for the setup is approximately 2.2 kHz.

Computations have also been performed on other shapes, but are not described in detail herein.

To evaluate accuracy of reconstructing ambisonics signal, simulated plane-waves with additive Gaussian noise were projected on the scatterer from a number of directions. FIG. 2 shows the response for the low-noise condition at a frequency of 1.5 kHz for the source orbiting the array in X=0 plane in 5 degree steps. The polar response for each TOA channel matches the corresponding spherical harmonic very well; for the lack of space, only four channels are shown (W, Y, T, R in FuMa nomenclature, which are $C_0^0$, $C_1^{-1}$, $C_1^{-2}$, and $C_2^0$, respectively). FIG. 3 demonstrates the deterioration of the response due to spatial aliasing at the frequency of 3 kHz. FIG. 4 shows the robustness to noise; in this figure, frequency is 1.5 kHz and SNR=0 dB. The response pattern deviates from the ideal one somewhat, but its features (lobes and nulls) are kept intact.

The methods, techniques, calculations, determinations, and other processes described herein can be implemented by a computing device. The computing device can include one or more data processors configured to execute instructions stored in a memory to perform one or more operations described herein. The memory may be one or more memory devices. In some implementations, the processor and the memory of the computing device may form a processing module. The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing processor with program instructions. The memory may include a floppy disk, compact disc read-only memory (CD-ROM), digital versatile disc (DVD), magnetic disk, memory chip, read-only memory (ROM), random-access memory (RAM), Electrically Erasable Programmable Read-Only Memory (EEPROM), erasable programmable read only memory (EPROM), flash memory, optical media, or any other suitable memory from which processor can read instructions. The instructions may include code from any suitable computer programming language such as, but not limited to, C. C++, C#, Java®, JavaScript®, Perl®, HTML, XML, Python®, and Visual Basic®.

The processor may process instructions and output data to generate an audio signal. The processor may process instructions and output data to, among other things, determine a plane-wave transfer function for the spatial-audio recording device based on a physical shape of the spatial-audio recording device, expand the plane-wave transfer function to generate a spherical-harmonics transfer function corresponding to the plane-wave transfer function, retrieve a plurality of signals captured by the microphones, determine spherical-harmonics coefficients for an audio signal based on the plurality of captured signals and the spherical-harmonics transfer function, and generate the audio signal based on the determined spherical-harmonics coefficients.

Microphones described herein can include any device configured to detect acoustic waves, acoustic signals, pressure, or pressure variation, including, for example, dynamic microphones, ribbon microphones, carbon microphones, piezoelectric microphones, fiber optic microphones, LASER microphones, liquid microphones, and microelectrical-mechanical system (MEMS) microphones.

Although some of the computing devices described herein include microphones, embodiments described herein may be implemented using a computing device separate and/or remote from microphones.

The audio signals generated by techniques described herein may be used for a wide variety of purposes. For example, the audio signals can be used in audio-video processing (e.g. film post-production), as part of a virtual or augmented reality experience, or for a 3d audio experience. The audio signals can be generated using the embodiments described herein to account for, and eliminate audio effects of, audio scattering that occurs when an incident sound wave scatters of microphones and/or a structure on which the microphones are attached. In this manner, a sound experience can be improved.

As described herein, there exists a problem in that conventional techniques do not provide for generating such improved audio signals in implementations in which microphones are attached to an arbitrary shaped body (scatterer), such as, for example, a non-spherical shaped microphone support. By using the techniques, methods, and processes described herein, a computing device can be configured to generate such an improved audio signal for an arbitrary shaped body, thus providing a set of instructions or a series of steps or processes which, when followed, provide for new computer functions that solve the above-mentioned problem.

As described above, embodiments for recovery of the incident acoustic field using a microphone array mounted on an arbitrarily-shaped scatterer are provided for. The scatterer influence on the field is characterized through an HRTF-like transfer function, which is computed in spherical harmonics domain using numerical methods, enabling one to obtain spherical spectra of the incident field from the microphone potentials directly via least-squares fitting. Incidentally, said spherical spectra include ambisonics representation of the field, allowing for use of such array as a HOA recording device. Simulations performed verify the proposed approach and show robustness to noise.

Evaluating HRTF for Different Wavenumbers

Usually computations of the scattering and related functions, such as the HRTF, is performed for a discrete set of frequencies or wavenumbers $k_1, \ldots, k_Q$ for the same scatterer. One problem is how to use these computations to evaluate these functions for some other k, presumably $k<k_q$, which means interpolation in the frequency domain. A solution is provided below.

Generally, it is noted then that the HRTF is a dimensionless function, so it can depend only on dimensionless parameter kD, where D is the diameter (the maximum size of the scatterer), and non-dimensional parameters characterizing the shape of the scatterer, location of the microphone (or ear), and direction (characterized by a unit vector s), which can be combined in a set of non-dimensional shape parameters P. This means that there is a similarity of the HRTFs computed for the bodies of the same shape and microphone (the same P) and different k's and different sizes, which keep kD the same:

$$H^{(k)}=H(kD,P) \tag{14}$$

Being a solution of the boundary value problem for the Helmholtz equation which dependence on kD is infinitely differentiable, the function can be expanded into the Taylor series at $kD\rightarrow 0$, $$H^{(k)} = H(kD, P) = \sum_{l=0}^{\infty} \frac{a_l}{l!}(kD)^l,\ a_l(P) = \left.\frac{\partial^n K(kD, P)}{\partial (kD)^n}\right|_{kD=0} \tag{15}$$

where coefficients $a_l$ do not depend on k. Note further that the Taylor series have some radius of convergence, which can range from 0 to infinity. In the case of the HTFR the radius is infinity, (e.g. for any kD one can take sufficient number of terms and truncate the infinite series to obtain a good enough approximation). This conclusion at this point can be considered as heuristic, and it is based on the observation that the Green's function for the Helmholtz equation is proportional to complex exponent, $e^{ikr}$, so the HRTFs computed for different k should have some factor proportional to $e^{ikr}$. In other words, their dependence on k should have exponential behavior. It is also well-known that the radius of the convergence for the exponent is infinite, which brings us to the idea that the series converge for any kD. Of course, more accurate consideration may prove this strictly, but we will assume that the series converges at least at for some range of kD.

As we have q functions H for values $k=k_1, \ldots, k_q$ and also we know that at zero frequency, $k_o=0$, we have $h^{(ko)}=1$, let us try to interpolate $H^{(k)}$ as $$H^{(k)} \approx \sum_{q=0}^{Q} c_q H^{(k_q)},\ K^{(k_q)} = H(k_q D, P) \tag{16}$$

where $c_q$ are coefficients, which we need to determine. Substituting expansion (2) into (3), we obtain $$\sum_{q=0}^{Q} c_q H^{(k_q)} = \sum_{q=0}^{Q} c_q \sum_{l=0}^{\infty} \frac{a_l}{l!}(k_q D)^l \tag{17}$$

-continued $$= \sum_{q=0}^{Q} c_q \sum_{l=0}^{\infty} \frac{a_l}{l!}\left(\frac{k_q}{k}\right)^l (kD)^l$$

$$= \sum_{l=0}^{\infty} \frac{a_l}{l!}(kD)^l \sum_{q=0}^{Q} c_q\left(\frac{k_q}{k}\right)^l$$

Comparing this with expansion (2) and equalizing the terms for the same power of $kD^l$, we can see that $$\sum_{q=0}^{Q} c_q\left(\frac{k_q}{k}\right)^l = 1,\ l = 0, 1, \ldots . \tag{18}$$

Of course, we cannot satisfy infinite number of equations with finite number of coefficients and either some least-square solution should be used, or we can simply satisfy equations for l=0, . . . , Q. In the latter case we have (Q+1)×(Q+1) linear system from which all $c_q$ can be determined $$\sum_{q=0}^{Q} c_q\left(\frac{k_q}{k}\right)^l = 1,\ l = 0, 1, \ldots , Q. \tag{19}$$

Note that the system matrix is the Van-der-Monde matrix, which has non-zero determinant, so a solution exists and is unique. It is also well-known that this matrix is usually poorly conditioned, so some numerical problems may appear. A good feature of the system is that at $k=k_{q'}$ we have an exact solution $$c_q\{_{0,\ q\neq q'}^{1,\ q=q'}, H^{(k)}=H^{(k_{q'})}, k=k_{q'}. \tag{20}$$

So, the interpolant takes exact values at all points k=, q=0, . . . , Q, that is, the approximate equality of Eq. 16 turns into exact equality at the given points. Note further, that the HRTF considered as a function of directions can be expanded over spherical harmonics $Y_n^m$ (s), $$H^{(k)}(s) = \sum_{n=0}^{\infty} \sum_{m=-n}^{n} H_n^{(k)m} Y_n^m(s) \tag{21}$$

Where the expansion coefficients $H_n^{(k)m}$ are functions of kD and non-dimensional scatterer shape parameters. Since $Y_n^m$ (s) does not depend on k, interpolation of the spherical spectrum can be using the same coefficients $c_q$ found as a solution of the system shown in Eq. 19. In other words, we have $$H_n^{(k)m} \approx \sum_{q=0}^{Q} c_q H_n^{m(k_q)} \tag{22}$$

In terms of interpolation of spectra, it is noted that spectra are usually truncated and have different size for different frequencies. So, for the interpolated values the length can be taken as the length for the closest $k_q$ exceeding k and spectra for other $k_q$ truncated to this size or extended by zero padding.

Finally, it is noted that the method proposed above is nothing but the Lagrange interpolation, where instead of a single function interpolated by the polynomial of degree Q taking the function values at the given points we have functions of many variables (additional parametric dependence on P or P\s).

Determining Time Harmonic Acoustic Fields from Measurements Provided by Microphones An arbitrary 3D spatial acoustic field in the time domain can be converted to the frequency domain using known techniques of segmentation of time signals followed by Fourier transforms. Inversely, time harmonic signals can be used to obtain signals in time domain. As such techniques are well developed, this disclosure will focus on the problem of recovery of time harmonic acoustic fields from measurements provided by M microphones.

Given circular frequency ω and point in space $r_0 \in R^3$ which we further will take as the origin of the reference frame, an arbitrary time harmonic field of acoustic pressure $p'(r,t) \sim \phi(r)e^{-i\omega t}$, where φ(r) is the complex amplitude, or phasor of the field, satisfies the Helmholtz equation in some vicinity of this point $$\nabla^2\phi + k^2\phi = 0, k = \omega/C, \tag{23}$$

where k and C is the wavenumber and the speed of sound. Moreover, such a field can be represented in the form of local expansion over the regular spherical basis functions, $\{R_n^m(r)\}$, with complex coefficients $\phi_n^m$ depending on frequency or k, $$\phi(r) = \sum_{n=0}^{\infty} \sum_{m=-n}^{n} \phi_n^m(k) R_n^m(r),\quad R_n^m(r) = j_n(kr) Y_n^m(s),\quad r = |r|,\quad s = \frac{r}{r}; \tag{24}$$

where s=(sin θ cos φ, sin θ sin φ, cos θ) is a unit vector represented via spherical polar angles θ and φ, $j_n(kr)$ is the spherical Bessel function of the first kind, and $Y_n^m$ are orthonormal spherical harmonics, defined as $$Y_n^m(s) = (-1)^m \sqrt{\frac{2n+1}{4\pi}\frac{(n-|m|)!}{(n+|m|)!}}\, P_n^{|m|}(\cos\theta) e^{im\varphi}, \tag{25}$$

$$n = 0,1,2,\ldots,\ m = -n, \ldots, n,$$

and $P_n^{|m|}$ (μ) are the associated Legendre functions.

It follows from Eq. 24 that full accurate representation of the field requires knowledge of infinite number of expansion coefficients for each frequency, which is not practical. Currently there exist several techniques for representation of actual field as superposition of time harmonic fields for a given set of frequencies or wavenumbers, which are based on truncation of the infinite series shown in Eq. 24, such as ambisonics, $$\phi(r) = \sum_{n=0}^{p-1} \sum_{m=-n}^{n} \phi_n^m(k) R_n^m(r) \tag{26}$$

The B-format of ambisonics corresponds top p=2 and therefore operates with four coefficients $\phi_0^0$, $\phi_1^{-1}$, $\phi_1^0$, and $\phi_1^1$. Higher order ambisonics use larger p such as p=3 (second order), p=4 (third order), etc. So there is a problem how to create the ambisonic formats from microphone recordings. There are also different formats for representation of spatial sound, such as multichannel formats Quad 5.1, etc. The formats ideally can be converted to each other, and differing from existing formats' representation of spatial sound can be of interest.

Here we consider the following problem. Given a scatterer of shape (surface) S with M microphones located on this surface (recording device, or field sensor), 1) produce ambisonic representation (spherical harmonic decomposition) of the acoustic field in the absence of the scatterer at the location of the scatterer center; 2) consider other representations of the acoustic field, which can be converted to ambisonic formats or synthesized from available ambisonic formats.

Given a scatterer of an arbitrary shape S and a point microphone located on the surface of the scatterer at point r=r*, the problem of determination of the incident field is closely related to the HRTF computation problem. Indeed, let us place the origin of the reference frame at some point inside the scatterer, namely, the point about which expansion of the incident field is sought, and consider the incident field in the form of a plane wave $$\Phi^{in}(r;s)=e^{-iks\cdot r},\ |s|=1 \tag{27}$$

where s is the direction of propagation of the plane wave, and k is the wavenumber. The total field is a sum of the incident and the scattered fields, $$\Phi(r;s)=\Phi^{in}(r;s)+\Phi^{scat}(r;s). \tag{28}$$

The plane wave (pw) HRTF is the value of the total field at the microphone location, $$H^{(pw)}(s;r_s)=\Phi(r_s;s),r_s\in S. \tag{29}$$

An arbitrary incident field can be expanded over the plane waves, $$\phi(r)=\int_{S_u}\Psi(s)e^{-iks\cdot r}dS(s) \tag{30}$$

where integration is taken over the surface of a unit sphere $S_u$ and $\Psi$ (s) is the signature function, which determination means determination of the incident field. Due to the linearity of the problem the measured field at the microphone location is $$\Phi(r_*)=\int_{S_u}\Psi(s)H^{(pw)}(s;r_*)dS(s) \tag{31}$$

Hence, if have M microphones, located at $r=r_1, \ldots, r_M$, and we have simultaneous measurements $\phi_1, \ldots, \phi_M$ of the field at these points, we should retrieve $\Psi$(s) from the system of equations $$\begin{aligned}
&\int_{S_u}\Psi(s)H^{(pw)}(s;r_1)dS(s)=\Phi(r_1)=\Phi_1,\\
&\int_{S_u}\Psi(s)H^{(pw)}(s;r_2)dS(s)=\Phi(r_2)=\Phi_2,\\
&\int_{S_u}\Psi(s)H^{(pw)}(s;r_M)dS(s)=\Phi(r_M)=\Phi_M,
\end{aligned} \tag{32}$$

Representation of the HRTF via spherical harmonic expansion can be expressed as:

$$H^{(pw)}(s;r_\Phi)=\sum_{n=0}^{\infty}\sum_{m=-n}^{n}H_n^m(r_*)Y_n^m(s) \tag{33}$$

and a method to compute $H_n^m(r^*)$ using the BEM can be implemented. Computation of unknown function $\Psi$(s) can be also done via its spherical harmonic spectrum $$\Psi(s)=\sum_{n=0}^{\infty}\sum_{m=-n}^{n}\Psi_n^m Y_n^m(s) \tag{34}$$

So the problem can be formulated as the problem of determination of several low degree coefficients in this expansion, $\Psi_n^m$. For orthonormal system of spherical harmonics Eq. 32 reduces to $$\begin{aligned}
&\sum_{n=0}^{\infty}\sum_{m=-n}^{n}\Psi_n^m H_n^{-m}(r_1)=\Phi_1,\\
&\sum_{n=0}^{\infty}\sum_{m=-n}^{n}\Psi_n^m H_n^{-m}(r_2)=\Phi_2,\\
&\cdots\\
&\sum_{n=0}^{\infty}\sum_{m=-n}^{n}\Psi_n^m H_n^{-m}(r_M)=\Phi_M
\end{aligned} \tag{35}$$

Now, for some $p^2<M$, we have overdetermined system $$\begin{aligned}
&\sum_{n=0}^{p-1}\sum_{m=-n}^{n}\Psi_n^m H_n^{-m}(r_1)=\Phi_1,\\
&\sum_{n=0}^{p-1}\sum_{m=-n}^{n}\Psi_n^m H_n^{-m}(r_2)=\Phi_2,\\
&\cdots\\
&\sum_{n=0}^{p-1}\sum_{m=-n}^{n}\Psi_n^m H_n^{-m}(r_M)=\Phi_M
\end{aligned} \tag{36}$$

which can be solved in the least square sense and so $\Psi_n^m$ can be determined for n=0, . . . , p−1 and m=−n, . . . , n, approximately. Eq (27) then enables determination of the incident field. Indeed, using the Gegenbauer expansion of the plane wave $$e^{-iks\cdot r}=4\pi\sum_{n=0}^{\infty}\sum_{m=-n}^{n}i^{-n}Y_n^{-m}(s)R_n^m(r), \tag{37}$$

we obtain $$\begin{aligned}
\phi(r)&=\int_{S_u}\Psi(s)e^{-iks\cdot r}dS(s)\\
&=\sum_{n=0}^{\infty}\sum_{m=-n}^{n}\Psi_n^m\int_{S_u}Y_n^m(s)e^{-iks\cdot r}dS(s)\\
&=\sum_{n=0}^{\infty}\sum_{m=-n}^{n}\Psi_n^m\int_{S_u}Y_n^m(s)4\pi\sum_{n'=0}^{\infty}\sum_{m'=-n'}^{n'}i^{-n'}Y_{n'}^{-m'}(s)R_{n'}^{m'}(r)dS(s)\\
&=4\pi\sum_{n=0}^{\infty}\sum_{m=-n}^{n}i^{-n}\Psi_n^m R_n^m(r)\approx 4\pi\sum_{n=0}^{p-1}\sum_{m=-n}^{n}i^{-n}\Psi_n^m R_n^m(r).
\end{aligned} \tag{38}$$

Clearly, $$\phi_n^m=4\pi i^{-n}\Psi_n^m, \tag{39}$$

where $$\phi(r) = \sum_{n=0}^{\infty} \sum_{m=-n}^{n} \phi_n^m R_n^m(r) \tag{40}$$

So the above method allows one to determine the low-degree coefficients in the expansion of the incident field. Particularly if there are M=6 microphones, $p^2=4$ coefficients, required for B-ambisonics, can be determined via least-squares techniques.

The major drawback of the direct spherical harmonics expansion is that this works only for the case when the wavelength of the sound wave is much larger that the size of the scatterer, or acoustic sensor. For example, if the scatterer can be enclosed in a cube with edge 12 centimeter (cm), which in its turn can be enclosed into a sphere of radius a about 10 cm (diameter 20 cm) then only sound with $ka \sim \leq 1$ can be treated with this method, which shows that $k \sim \leq 10$ $m^{-1}$, $f = kC/2\pi \sim \leq 500$ Hz, which can be considered as a low-frequency range of the audible sound.

So, to treat the problem for higher frequencies we propose to use spatial source localization techniques. In terms of decomposition over the plane waves this means determination of the directions and complex amplitudes of such waves. The main assumption here is that the sound is generated by L plane waves characterized by directions $s_1$, $s_2$, . . . , $s_L$, and complex amplitudes $A_{j1}$, $A_{j2}$, . . . , $A_{jL}$ for F frequencies $f_1$, . . . , $f_F$ or wavenumbers $k_1$, . . . , $k_F$ (j=1, . . . , F). This means that for a given frequency, we have $$\phi_j(r) = \sum_{l=1}^{L} A_{jl} e^{-iks_l \cdot r}. \tag{41}$$

This is consistent with Eq. 27, where we should set $$\Psi_j(s) = \sum_{l=1}^{L} A_{jl} \delta(s - s_l) \tag{42}$$

where δ(s) is Dirac's delta-function. Respectively, the microphone readings described by Eq. 29 will be $$\sum_{l=1}^{L} A_{jl} H_j^{(pw)}(s_l; r_q) = \Phi_{jp}, \quad q = 1, \ldots, M, \quad j = 1, \ldots, F, \tag{43}$$

where $H_j^{(pw)}(s_1; r_q)$ denotes the plane wave transfer function for wavenumber $k_j$ (wave direction $s_1$, surface point coordinate $r_q$) and $\phi_{jq}$ the complex sound amplitude read by the qth microphone at the jth frequency.

It is important to note that the construction and arrangement of the various exemplary embodiments are illustrative only. Although only a few embodiments have been described in detail in this disclosure, those skilled in the art who review this disclosure will readily appreciate that many modifications are possible without materially departing from the teachings and advantages of the subject matter described herein. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

The following references are incorporated herein by reference in their entirety.

[1] M. Brandstein and D. Ward (Eds.) (2001). "Microphone Arrays: Signal Processing Techniques and Applications", Springer-Verlag, Berlin, Germany.

[2] R. Duraiswami, D. N. Zotkin, Z. Li, E. Grassi, N. A. Gumerov, and L. S. Davis (2005). "High order spatial audio capture and its binaural head-tracked playback over headphones with HRTF cues", Proc. AES 119th Convention, New York, N.Y., October 2005, preprint #6540.

[3] J. J. Gibson, R. M. Christenses, and A. L. R. Limberg (1972). "Compatible FM broadcasting of panoramic sound", Journal Audio Engineering Society, vol. 20, pp. 816-822.

[4] M. A. Gerzon (1973). "Periphony: With-height sound reproduction", Journal Audio Engineering Society, vol. 21, pp. 2-10.

[5] M. A. Gerzon (1980). "Practical periphony", Proc. AES 65th Convention, London, UK, February 1980, preprint #1571.

[6] T. Abhayapala and D. Ward (2002). "Theory and design of high order sound field microphones using spherical microphone array", Proc. IEEE ICASSP 2002, Orlando, Fla., vol. 2, pp. 1949-1952.

[7] J. Meyer and G. Elko (2002). "A highly scalable spherical microphone array based on an orthonormal decomposition of the soundfield", Proc. IEEE ICASSP 2002, Orlando, Fla., vol. 2, pp. 1781-1784.

[8] P. Lecomte, P.-A. Gauthier, C. Langrenne, A. Garcia, and A. Berry (2015). "On the use of a Lebedev grid for Ambisonics", Proc. AES 139th Convention, New York, N.Y., October 2015, preprint #9433.

[9] A. Avni and B. Rafaely (2010). "Sound localization in a sound field represented by spherical harmonics", Proc. 2nd International Symposium on Ambisonics and Spherical Acoustics, Paris, France, May 2010, pp. 1-5.

[10] S. Braun and M. Frank (2011). "Localization of 3D Ambisonic recordings and Ambisonic virtual sources", Proc. 1st International Conference on Spatial Audio (ICSA) 2011, Detmold, Germany, November 2011.

[11] S. Bertet, J. Daniel, E. Parizet, and O. Warusfel (2013). "Investigation on localisation accuracy for first and higher order Ambisonics reproduced sound sources", Acta Acustica united with Acustica, vol. 99, pp. 642-657.

[12] M. Frank, F. Zotter, and A. Sontacchi (2015). "Producing 3D audio in Ambisonics", Proc. AES 57th Intl. Conference, Hollywood, Calif., March 2015, paper #14.

[13] L. Kumar (2015). "Microphone array processing for acoustic source localization in spatial and spherical harmonics domain", Ph.D. thesis, Department of Electrical Engineering, IIT Kanpur. Kanpur, Uttar Pradesh, India.

[14] Y. Tao, A. I. Tew, and S. J. Porter (2003). "The differential pressure synthesis method for efficient acoustic pressure estimation", Journal of the Audio Engineering Society, vol. 41, pp. 647-656.

[15] M. Otani and S. Ise (2006). "Fast calculation system specialized for head-related transfer function based on boundary element method", Journal of the Acoustical Society of America, vol. 119, pp. 2589-2598.

[16] N. A. Gumerov, A. E. O'Donovan, R. Duraiswami, and D. N. Zotkin (2010). "Computation of the head-related transfer function via the fast multipole accelerated boundary element method and its spherical harmonic representation", Journal of the Acoustical Society of America, vol. 127(1), pp. 370-386.

[17] N. A. Gumerov, R. Adelman, and R. Durasiwami (2013). "Fast multipole accelerated indirect boundary elements for the Helmholtz equation", Proceedings of Meetings on Acoustics, vol. 19, EID #015097.

[18] D. N. Zotkin and R. Duraiswami (2009). "Plane-wave decomposition of acoustical scenes via spherical and cylindrical microphone arrays", IEEE Transactions on Audio, Speech, and Language Processing, vol. 18(1), pp. 2-16.

[19] M. Abramowitz and I. Stegun (1964). "Handbook of Mathematical Functions", National Bureau of Standards, Government Printing Office.

[20] T. Xiao and Q.-H. Lui (2003). "Finite difference computation of head-related transfer function for human hearing", Journal of the Acoustical Society of America, vol. 113, pp. 2434-2441.

[21] D. N. Zotkin, R. Duraiswami, E. Grassi, and N. A. Gumerov (2006). "Fast head-related transfer function measurement via reciprocity", Journal of the Acoustical Society of America, vol. 120(4), pp. 2202-2215.

[22] N. A. Gumerov and R. Duraiswami (2004). "Fast multipole methods for the Helmholtz equation in three dimensions", Elsevier Science, The Netherlands.

[23] D. N. Zotkin, R. Duraiswami, and N. A. Gumerov (2009). "Regularized HRTF fitting using spherical harmonics", Proc. IEEE WASPAA 2009, New Paltz, N.Y., October 2009, pp. 257-260.

[24] J. Fliege and U. Maier (1999). "The distribution of points on the sphere and corresponding cubature formulae", IMA Journal of Numerical Analysis, vol. 19, pp. 317-334.

[25] Zhiyun Li, Ramani Duraiswami (2007). "Flexible and optimal design of spherical microphone arrays for beamforming," IEEE Transactions on Speech and Audio Processing, 15:702-714.

[26] B. Rafaely (2005). "Analysis and design of spherical microphone arrays", IEEE Transactions on Speech and Audio Processing, vol. 13(1), pp. 135-143.

What is claimed is:

1. A spatial-audio recording system, comprising:

a spatial-audio recording device comprising a plurality of microphones; and a computing device configured to:

determine a plane-wave transfer function for the spatial-audio recording device based on a physical shape of the spatial-audio recording device;

expand the plane-wave transfer function to generate a spherical-harmonics transfer function corresponding to the plane-wave transfer function;

retrieve a plurality of signals captured by the microphones;

determine spherical-harmonics coefficients for an audio signal based on the plurality of captured signals and the spherical-harmonics transfer function; and generate the audio signal based on the determined spherical-harmonics coefficients.

2. The system of claim 1, wherein:

the computing device is further configured to generate the audio signal based on the determined spherical-harmonics coefficients by performing processes that include converting the spherical-harmonics coefficients to ambisonics coefficients.

3. The system of claim 1, wherein:

the computing device is configured to determine the spherical-harmonics coefficients by performing processes that include setting a measured audio field based on the plurality of signals equal to an aggregation of a signature function comprising the spherical-harmonics coefficients and the spherical-harmonics transfer function.

4. The system of claim 3, wherein:

the computing device is further configured to determine the signature function comprising spherical-harmonics coefficients by expanding a signature function that describes a plane wave strength as a function of direction over a unit sphere into the signature function comprising spherical-harmonics coefficients.

5. The system of claim 1, wherein:

the computing device is configured to determine the plane-wave transfer function for the spatial-audio recording device by performing operations that comprise implementing a fast multipole-accelerated boundary element method, or based on previous measurements of the spatial-audio recording device.

6. The system of claim 1, wherein:

the plurality of microphones are distributed over a non-spherical surface of the spatial-audio recording device.

7. The system of claim 1, wherein:

the computing device is configured to determine the spherical-harmonics coefficients based on the plurality of captured signals and the spherical-harmonics transfer function by performing operations that comprise implementing a least-squares technique.

8. The system of claim 1, wherein:

the computing device is configured to determine a frequency-space transform of one or more of the captured signals.

9. The system of claim 1, wherein:

the computing device is configured to generate the audio signal corresponding to an audio field generated by one or more external sources and substantially undisturbed by the spatial-audio recording device.

10. The system of claim 1, wherein the spatial-audio recording device is a panoramic camera.

11. The system of claim 1, wherein the spatial-audio recording device is a wearable device.

12. A method of generating an audio signal, comprising:

determining a plane-wave transfer function for a spatial-audio recording device comprising a plurality of microphones based on a physical shape of the spatial-audio recording device;

expanding the plane-wave transfer function to generate a spherical-harmonics transfer function corresponding to the plane-wave transfer function;

retrieving a plurality of signals captured by the microphones;

determining spherical-harmonics coefficients based on the plurality of captured signals and the spherical-harmonics transfer function; and generating an audio signal based on the determined spherical-harmonics coefficients.

13. The method of claim 12, wherein:

the generating the audio signal based on the determined spherical-harmonics coefficients comprises converting the spherical-harmonics coefficients to ambisonics coefficients.

14. The method of claim 12, wherein:

the determining the plane-wave transfer function for the spatial-audio recording device comprises implementing a fast multipole-accelerated boundary element method, or based on previous measurements of the spatial-audio recording device.

15. The method of claim 12, wherein:

determining the spherical-harmonics coefficients comprises setting a measured audio field based on the plurality of signals equal to an aggregation of a signature function comprising the spherical-harmonics coefficients and the spherical-harmonics transfer function.

16. The method of claim 15, further comprising:

determining the signature function comprising spherical-harmonics coefficients by expanding a signature function that describes a plane-wave strength as a function of direction over a unit sphere into the signature function comprising spherical-harmonics coefficients.

17. The method of claim 12, wherein:

the spherical-harmonics transfer function corresponding to the plane-wave transfer function satisfies the equation:

$$H(k, s, \tau_j) = \sum_{n=0}^{p-1} \sum_{m=-n}^{n} H_n^m(k, \tau_j) Y_n^m(s),$$

where $H(k,s,r_j)$ is the plane-wave transfer function, $H_n^m(k, r_j)$ constitute the spherical-harmonics transfer function, $Y_n^m(s)$ are orthonormal complex spherical harmonics, k is a wavenumber of the captured signals, s is a vector direction from which the captured signals are arriving, n is a degree of a spherical mode, m is an order of a spherical mode, and p is a predetermined truncation number.

18. The method of claim 12, wherein:

the signature function comprising spherical-harmonics coefficients is expressed in the form:

$$\mu(k, s) = \sum_{n=0}^{p-1} \sum_{m=-n}^{n} C_n^m(k) Y_n^m(s),$$

where $\mu(k,s)$ is the signature function, $C_n^m(k)$ constitute the spherical-harmonics coefficients, $Y_n^m(s)$ are orthonormal complex spherical harmonics, k is a wavenumber of the captured signals, s is a vector direction from which the captured signals are arriving, n is a degree of a spherical mode, m is an order of a spherical mode, and p is a predetermined truncation number.

19. The method of claim 12, wherein the spatial-audio recording device is a panoramic camera.

20. The method of claim 12, wherein the spatial-audio recording device is a wearable device.

21. A spatial-audio recording device comprising:

a plurality of microphones; and a computing device configured to:

determine a plane-wave transfer function for the spatial-audio recording device based on a physical shape of the spatial-audio recording device;

expand the plane-wave transfer function to generate a spherical-harmonics transfer function corresponding to the plane-wave transfer function;

retrieve a plurality of signals captured by the microphones;

determine spherical-harmonics coefficients based on the plurality of captured signals and the spherical-harmonics transfer function;

convert the spherical-harmonics coefficients to ambisonics coefficients; and generate an audio signal based on the ambisonics coefficients.

22. The spatial-audio recording device of claim 21, wherein:

the computing device is configured to determine the plane-wave transfer function for the spatial-audio recording device based on a mesh representation of the physical shape of the spatial-audio recording device.

23. The spatial-audio recording device of claim 21, wherein:

the audio signal is an augmented audio signal.

24. The spatial-audio recording device of claim 21, wherein:

the microphones are distributed over a non-spherical surface of the spatial-audio recording device.

25. The spatial-audio recording device of claim 21, wherein the spatial-audio recording device is a panoramic camera.

26. The spatial-audio recording device of claim 21, wherein the spatial-audio recording device is a wearable device.

* * * * *